US005454650A

United States Patent [19]

Yamaguchi

[11] Patent Number: 5,454,650

[45] Date of Patent: Oct. 3, 1995

[54] TAPE CASSETTE

[75] Inventor: Koshiro Yamaguchi, Kasugai, Japan

[73] Assignee: Brother Kogyo Kabushiki Kaisha, Nagoya, Japan

[21] Appl. No.: 200,709

[22] Filed: Feb. 23, 1994

[30] Foreign Application Priority Data

May 19, 1993 [JP] Japan ..... 5-141424

[51] Int. Cl.[6] ..... B41J 35/28

[52] U.S. Cl. ..... 400/208; 400/692; 400/703

[58] Field of Search ..... 400/207, 208, 400/692, 613, 234, 249, 703

[56] References Cited

U.S. PATENT DOCUMENTS

| | | | |
|---|---|---|---|
| 4,367,963 | 1/1983 | Daughters | 400/207 |
| 4,480,936 | 11/1984 | Kasun et al. | 400/207 |
| 4,970,531 | 11/1990 | Shimizu et al. | 400/249 |
| 5,087,137 | 2/1992 | Burnard et al. | 400/249 |
| 5,124,845 | 6/1992 | Shimojo | 359/838 |
| 5,222,818 | 6/1993 | Akiyama et al. | 400/61 |
| 5,248,207 | 9/1993 | Yamamoto et al. | 400/692 |
| 5,284,396 | 2/1994 | Masumura et al. | 400/234 |

FOREIGN PATENT DOCUMENTS

| | | |
|---|---|---|
| 0573187 | 12/1993 | European Pat. Off. . |
| 0573188 | 12/1993 | European Pat. Off. . |
| 4-32290 | 8/1992 | Japan . |

*Primary Examiner*—Ren Yan

*Attorney, Agent, or Firm*—Oliff & Berridge

[57] ABSTRACT

A ribbon unit and a tape unit are accommodated for replacement in a tape cassette. The ribbon unit includes an ink ribbon, a ribbon spool around which the ink ribbon is wound, a ribbon guide roller, a ribbon holder lid and a ribbon holder body. A boss is provided on a cassette case body, and a back tension spring is anchored at a recessed portion of the boss. When a ribbon unit is mounted in the cassette housing, the back tension spring becomes flexible by a ribbon spool.

18 Claims, 11 Drawing Sheets

TAPE CASSETTE

BACKGROUND OF THE INVENTION

1. Field of the Invention

The present invention relates to a tape cassette for use with a tape producing apparatus, and more particularly, to a tape cassette for exclusively printing on a tape-like printing medium (hereinafter referred to simply as "a tape") using a tape using an ink ribbon.

2. Description of the Related Art

A tape cassette for use with a tape producing apparatus of this type is conventionally constructed such that a tape and an ink ribbon having substantially equal widths are accommodated in a corresponding relationship in a single cassette case, and also the lengths of the tape and the ink ribbon are substantially equal to each other. After the tape or the ink ribbon is used up, the entire cassette case is replaced, and the cassette case after use is scrapped. A tape cassette of the type just described is disclosed, for example, in Japanese Utility Model Publication No. Hei 4-32290.

However, there is room for improvement in the following points in the conventional tape cassette described above.

As the amount of use of tapes increases, the amount of scrapped cassette cases increases, and consequently, effective use of resources is not achieved, and cinders and smoke produced upon burning of cassette cases damages the environment. If the lengths of the tape and the ink ribbon accommodated in a tape cassette are increased to a great extent, then the amount of the scrapped cassette case per unit length of the tape decreases. However, this raises new problems that the size of the cassette case must be necessarily increased and that also the size of a tape producing apparatus with which the cassette case is used must be increased.

Further, for a user who wants to use common tapes having different printing colors and/or widths, different cassette cases must be necessarily prepared. This raises such problems that a high cost is required and that a large space is required for accommodation of cassette cases.

SUMMARY OF THE INVENTION

The present invention has been made to solve the problems described above, and it is an object of the present invention to provide a tape cassette, wherein the printing color and/or the printing width can be selected comparatively freely by a user and printing of different colors and/or different sizes can be performed on the same tape.

In order to attain the object described above, according to the present invention, a tape cassette for use with a tape producing apparatus for exclusively printing on a tape using an ink ribbon is constructed such that the ink ribbon is formed in a unit, and the ink ribbon unit is constructed for replacement from the tape cassette.

With the tape cassette of the present invention having the construction described above, replacement of the ink ribbon (unit) is easy, and the same tape can be printed using ink ribbons of different colors to accommodate varying user needs. Further, it is also possible to use a multi-time ink ribbon.

As apparent from the foregoing description, according to a tape cassette of the present invention, a user can replace an ink ribbon freely, and printing can be performed in various colors and with various sizes on the same tape.

DETAILED DESCRIPTION OF PREFERRED EMBODIMENTS

In the following, a tape cassette in an embodiment according to the present invention will be described with reference to the drawings.

Figure 1:
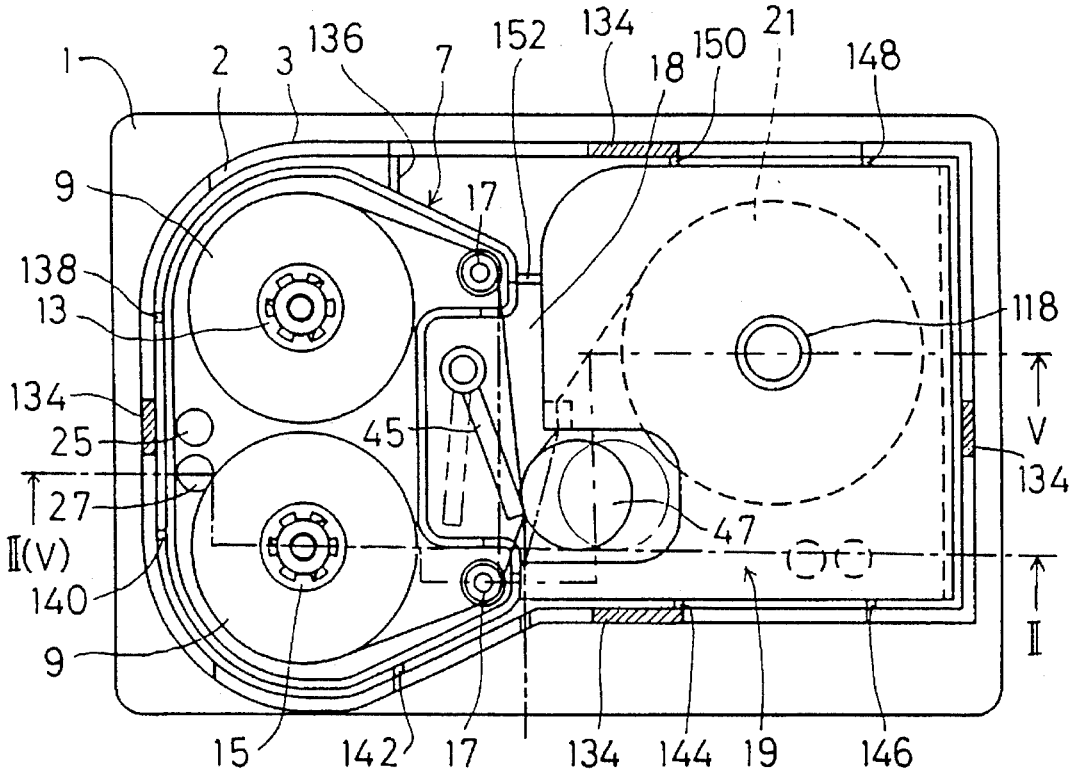
FIG. 1 is a plan view showing a tape cassette in a preferred embodiment according to the present invention in a condition wherein the tape cassette is mounted in an apparatus body with a cassette case lid removed.
Figure 2:
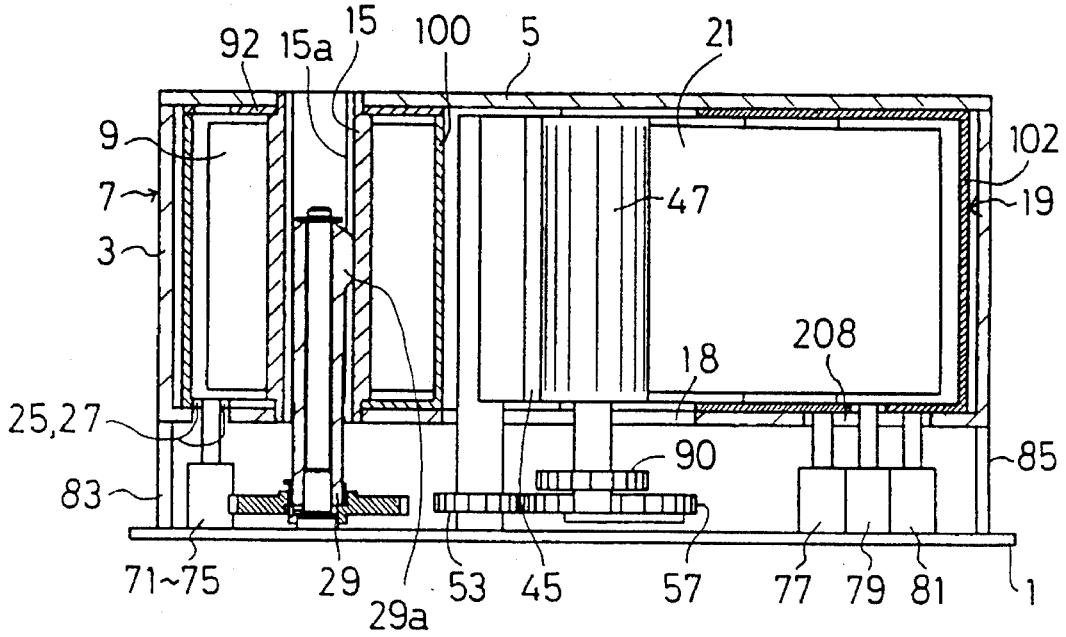
FIG. 2 is a sectional view of the tape cassette, taken along a line II—II of FIG. 1.
Figure 3:
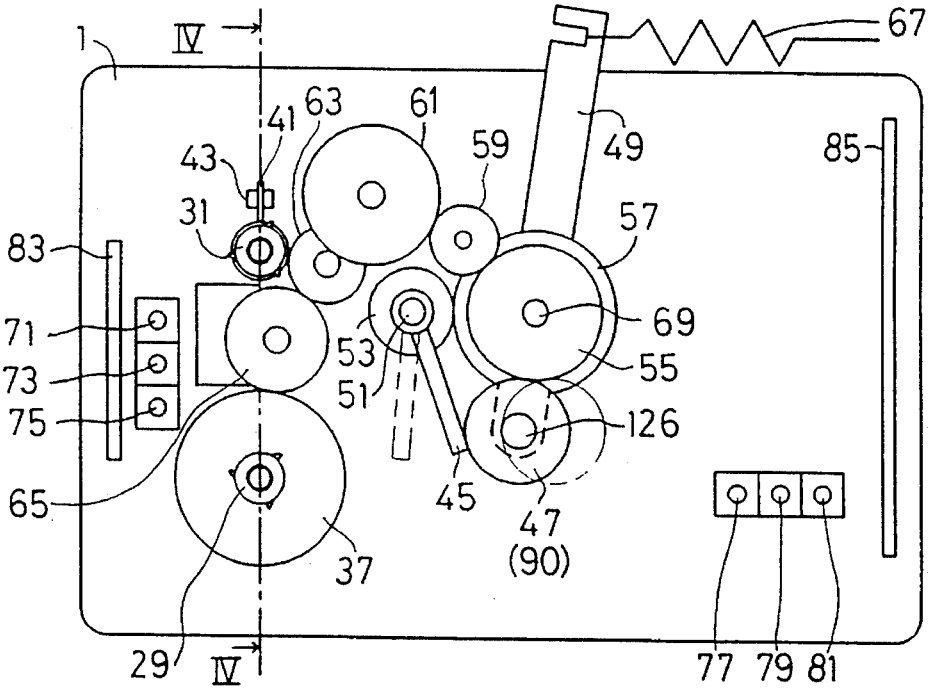
FIG. 3 is a plan view of a tape producing apparatus according to the present invention.
Figure 4:
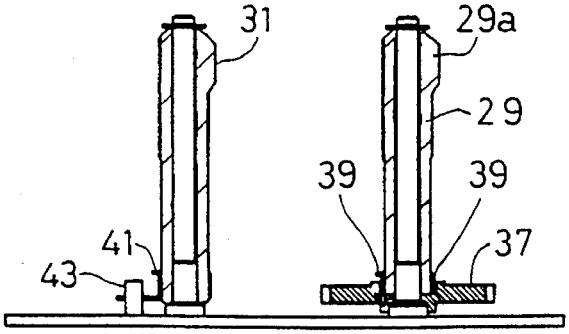
FIG. 4 is a sectional view of the tape producing apparatus, taken along a line IV—IV of FIG. 3.

FIG. 1 is a plan view illustrating a condition wherein a tape cassette (in a condition wherein a lid is open) 2 is mounted in a tape producing apparatus body 1; FIG. 2 is a sectional view taken along a line II—II of FIG. 1; FIG. 3 is a plan view showing the tape producing apparatus body 1 before the tape cassette 2 is mounted; FIG. 4 is a sectional view taken along a line IV—IV of FIG. 3; and FIG. 5 is a sectional view taken along a line V—V of FIG. 1.

Figure 9:
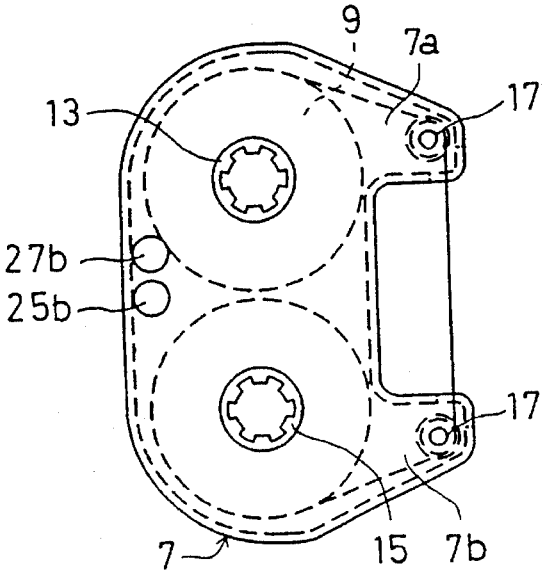
FIG. 9 is a bottom plan view of the ink ribbon unit.
Figure 10A:
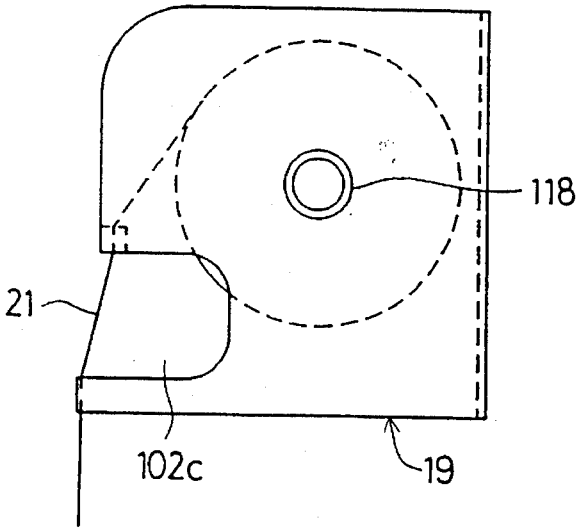
FIG. 10A shows a plan view of a tape unit.
Figure 10B:
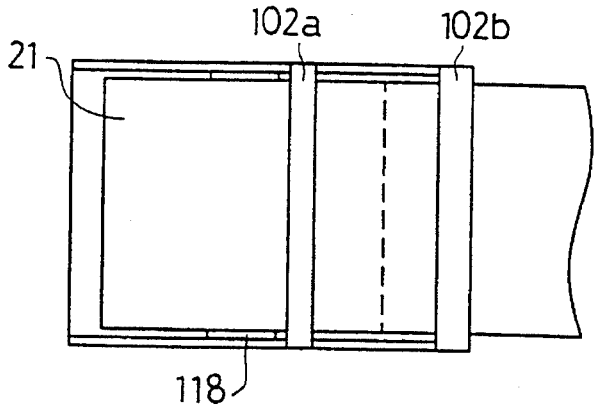
FIG. 10B is a front elevational view of a tape unit.
Figure 10C:
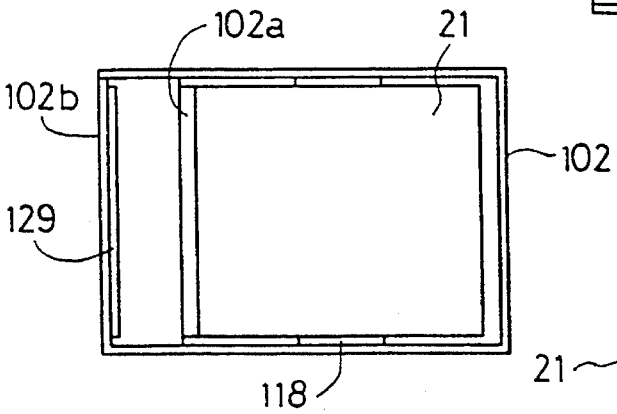
FIG. 10C is a side elevational view of a tape unit.
Figure 10D:
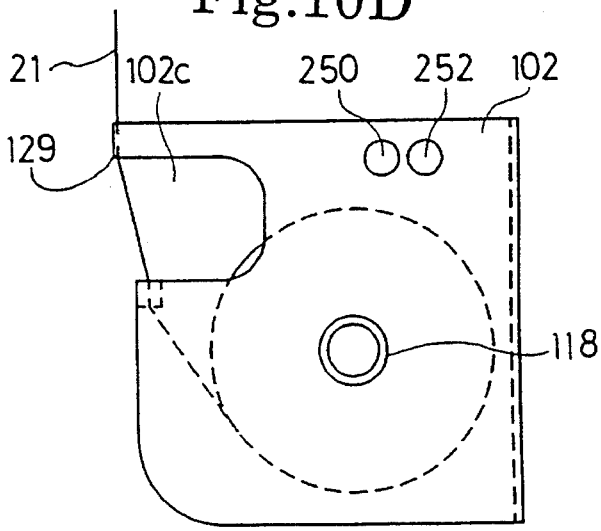
FIG. 10D is a bottom plan view of a tape unit.

As shown in FIGS. 1, 2 and 9, a ribbon unit 7 and a tape unit 19 are accommodated for individual replacement in a cassette case body 3 of the tape cassette (cassette case) 2. The ribbon unit 7 includes a ribbon holder body 100 including a housing having an elliptical shape as viewed in plan and a pair of arm portions 7*a* and 7*b* extending in a predetermined spaced relationship from a side face of the housing, and a ribbon holder lid 92 for covering the ribbon holder body 100. A pair of ribbon spools 13 and 15 are provided in the ribbon holder body 100. A pair of ribbon guide rollers 17 and 17 are supported for rotation at end portions of the arm portions 7*a* and 7*b*, and an exit for an ink ribbon 9 is formed at an end of the arm portion 7*a* on the ribbon spool 13 side while an entrance for the ink ribbon 9 is formed at an end of the arm portion 7*a* on the ribbon spool 15 side. The ink ribbon 9 is wound on the spool 13 and is partially exposed to the outside of the ribbon holder 100 from the exit under the guidance of the ribbon guide roller 17, enters into the ribbon holder 100 again by way of the entrance, and is wound on the ribbon spool 15 under the guidance of the ribbon guide roller 17. The positions in the vertical direction are defined in the proximity of the exit and the entrance by the ribbon guide rollers 17 and 17.

Figure 5:
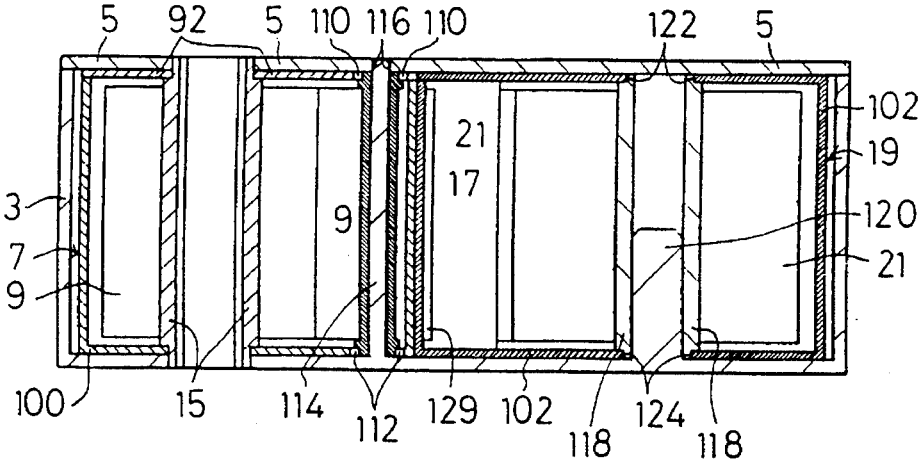
FIG. 5 is a sectional view of the tape cassette, taken along a line V—V of FIG. 1.

As shown in FIG. 5, the ribbon guide roller 17 is mounted through a hole 112 and another hole 110 formed at ends of the arm portions of the ribbon holder body 100 and the ribbon holder lid 92, respectively, and when the ribbon unit 7 is mounted in the cassette case body 3, a shaft 114 extending uprightly from a bottom wall of the cassette case body 3 is fitted into the ribbon guide roller 17 to position the ribbon guide roller 17 while high rigidity is obtained simultaneously. The shaft 114 is fitted in and fixed to a hole 116 of a cassette case lid 5. Further, as shown in FIG. 2, a pair of sensor holes 25 and 27 are formed in a bottom wall of the ribbon holder body 100.

As shown in FIGS. 5, 10A, 10B, 10C and 10D, the tape unit 19 includes a tape holder 102 having a U-shaped cross-section, and upper and lower walls of the tape holder 102 are connected to each other via a pair of ribs 102*a* and 102*b*. A tape 21 wound on a spool 118 is accommodated in the tape holder 102. A recessed portion 102*c* is formed at a portion of the tape holder 102 between the pair of ribs 102*a* and 102*b*, and when the tape cassette 2 is mounted in the tape producing apparatus body 1, a platen 47 is inserted into the recessed portion 102*c*. Further, fitting holes 129 for guiding the tape 21 to the outside of the tape unit 19 are formed in the pair of ribs 102*a* and 102*b*. The spool 118 is mounted in a hole 122 and another hole 124 in the top and the bottom of the tape holder 102, and when the tape unit 19 is mounted in the tape cassette body 3, the spool 118 is fitted onto and positioned by a boss 120 (FIG. 5) of the cassette case body 3. The top and the bottom of the tape 21 are guided by a fitting hole 129 in the rib 102*b* in the proximity of the exit of the tape holder 102. Accordingly, the upward and downward positions of the ink ribbon 9 and the tape 21 are defined by the ribbon unit 7 and the tape unit 19, respectively, and their horizontal positions are defined by the cassette case body 3 and the cassette case lid 5.

The structure and operation of the tape producing apparatus body 1 will be described. As shown in FIGS. 2 and 3, a thermal head 45 is supported for integral pivotal motion with a gear 53 formed integrally therewith on the apparatus body 1 by means of a shaft 51. A platen 47, integral with a gear 90, is supported for rotation on a shaft 126 on a lever 49, and the gear 90 is held in mesh with another gear 55 integral with a shaft 69. The platen 47 is rotated as rotation of a motor gear 65 is transmitted to the gear 90 by way of gears 63, 61, 59 and 55. The motor gear 65 is held in mesh with a ribbon driving gear 37, and rotation of the ribbon driving gear 37 is transmitted to a ribbon driving cam 29 by way of a clutch spring 39 (FIG. 4). As shown in FIG. 4, the clutch spring 39 is anchored at one end of the gear 37 and is freely wrapped around the ribbon driving cam 29 at the other end of the gear. The ribbon driving cam 29 and the clutch spring 39 absorb a variation of the winding amount of the ink ribbon 9 and produce torque necessary to take up the ink ribbon 9 when the diameter of the wound ink ribbon 9 varies.

A gear 57 is secured to the lever 49 and is positioned below the gear 55. When the lever 49 is operated leftward from the position shown in FIG. 3 against a spring 67, the gear 57 is rotated counterclockwise while the gear 53 is rotated clockwise so that the platen 47 is moved rightward and the thermal head 45 is moved leftward to put the platen 47 and the thermal head 45 into a separated condition. In the condition shown in FIG. 3, the thermal head 45 and the platen 47 are in a mutually contacting condition by the action of the spring 67. When the cassette case body 3 is mounted in the apparatus body 1, the thermal head 45 and the platen 47 are inserted into an opening 18 of the cassette case body 3 while the thermal head 45 and the platen 47 are in a spaced condition from each other. In this instance, since the ink ribbon 9 and the tape 21 are in the positions indicated by a two-dot chain line in FIG. 1, they will not interfere with the thermal head 45 nor the platen 47.

Ribbon sensors 71, 73, 75 and tape sensors 71, 73, 75, 77, 79 and 81 are carried on the apparatus body 1, and the type of the ink ribbon 9 and the type of the tape 21 are discriminated from ON/OFF conditions of the sensors. When the cassette case body 3 is mounted in the apparatus body 1 as shown in FIG. 2, the positions of the cassette case body 3 in the vertical direction are defined by a rib 83 and another rib 85 on the apparatus body 1. Further, the ribbon driving cam 29 and the ribbon spool 15 are held in mesh with each other at a projection 29*a* formed at an upper end of the ribbon driving cam 29 and a portion of a slot 15*a* formed in the ribbon spool 15 so that rotation is transmitted between them. A ribbon supply cam 31 and the ribbon spool 13 are similarly held in mesh with each other. A back tension spring 41 is wound on the ribbon supply cam 31 and is fixed to a rib 43 at one end thereof on the apparatus body 1 as shown in FIGS. 3 and 4. When the ink ribbon 9 is rotated clockwise in the condition of FIG. 1, tension is applied to the ink ribbon 9 by friction force between the ribbon supply cam 31 and the back tension spring 41.

Figure 6:
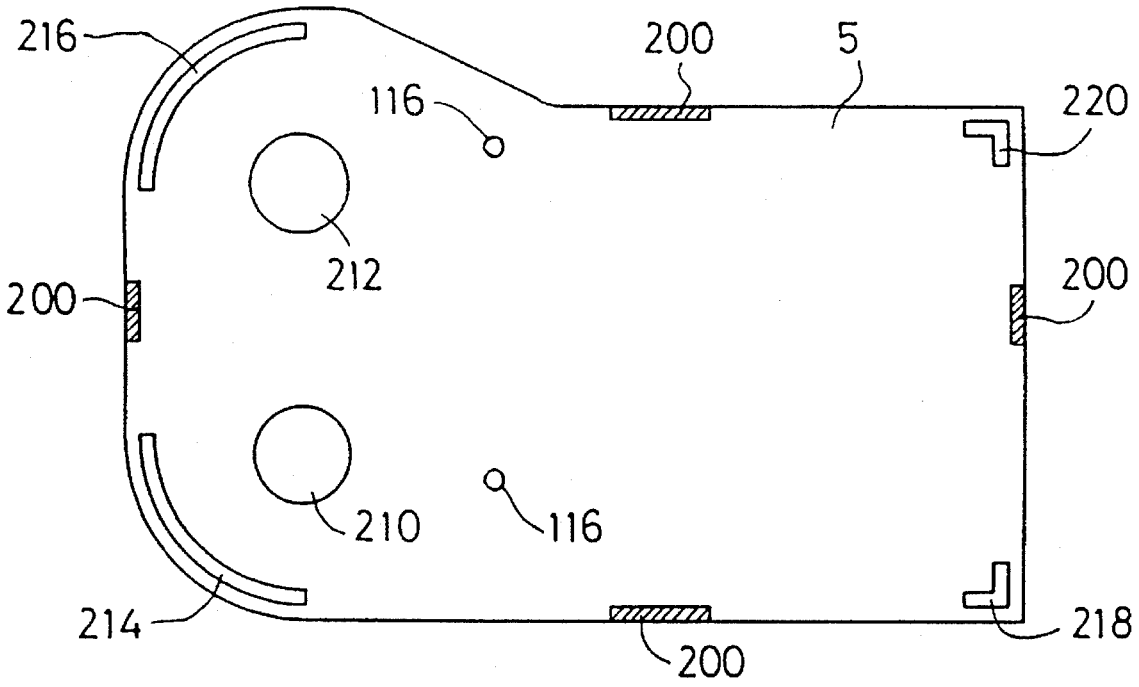
FIG. 6 is a bottom plan view of the cassette case lid.

The tape cassette 2 will now be described in more detail. As described hereinabove, the ribbon unit 7 and the tape unit 19 are accommodated in the cassette case body 3 as shown in FIG. 1. The ribbon unit 7 is positioned in the horizontal direction by ribs 136, 138, 140, 142 and 152 on the cassette case body 3, and the tape unit 19 is positioned in the horizontal direction by ribs 144, 146, 148, 150 and 152. Further, magnets 134 are provided at four locations on the cassette base body 3, and the cassette case body 3 and the cassette case lid 5 are fixed by iron plates 200 at four locations of the cassette case lid 5 and mounted corresponding to the magnets 134 as shown in FIG. 6. Accordingly, the operator can remove the cassette case lid 5 readily from the cassette case body 3, and the ribbon unit 7 or the tape unit 19 in the cassette case 3 can be replaced readily.

Figure 7:
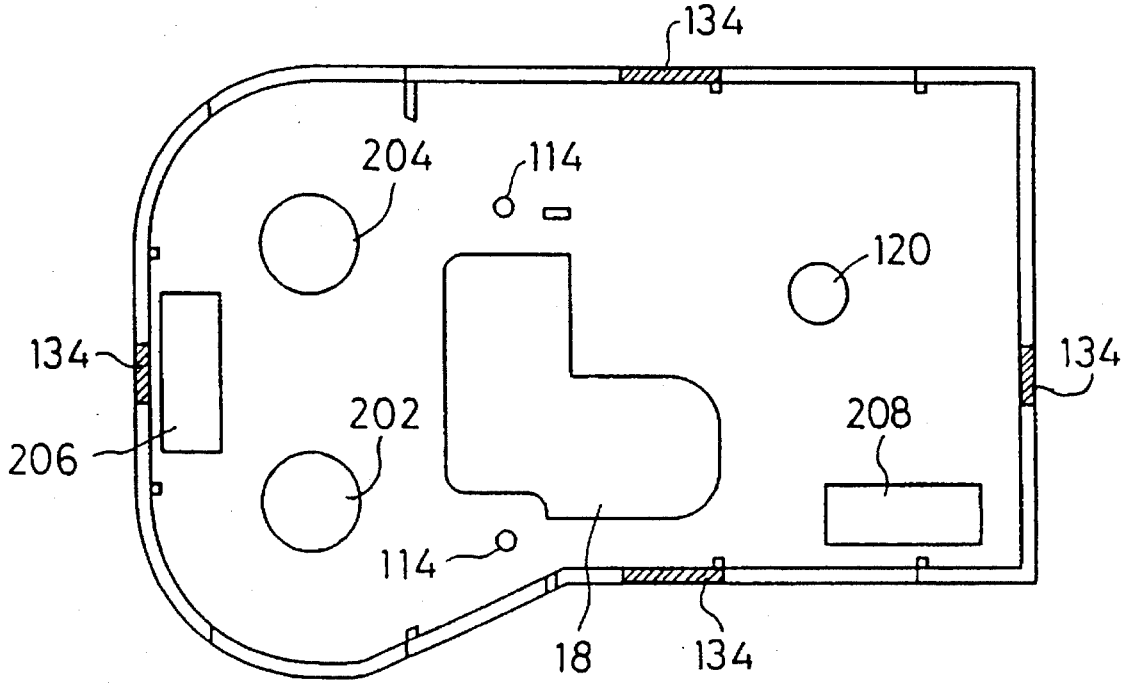
FIG. 7 is a plan view of a cassette case body.
Figure 8A:
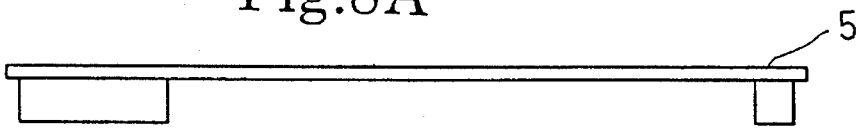
FIG. 8A is a side elevational view of a tape cassette lid.
Figure 8B:
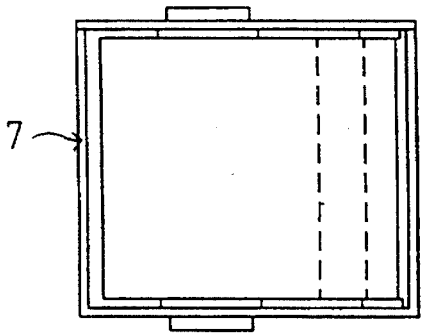
FIG. 8B is a side elevational view of a ribbon unit.
Figure 8C:
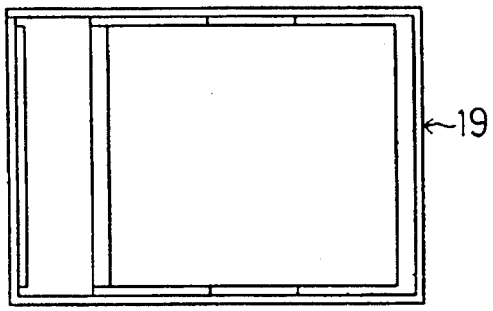
FIG. 8C is a side elevational view of a tape unit.
Figure 8D:
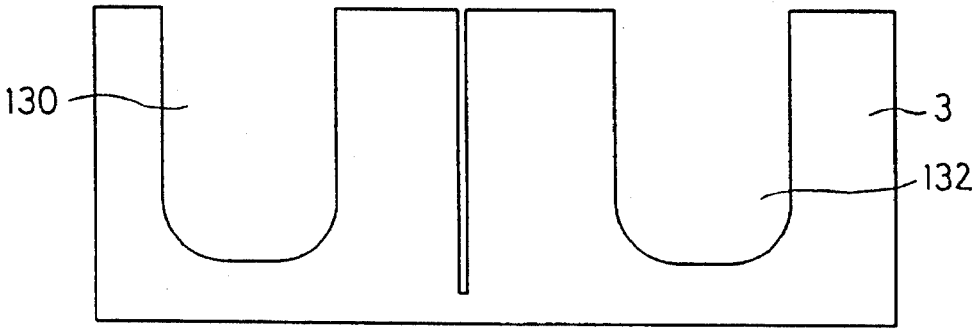
FIG. 8D is a side elevational view of a cassette case body.

Recesses 130, 132 are provided at two right and left locations so as to further facilitate replacement of the ribbon unit 7 or the tape unit 19 as shown in FIGS. 8A, 8B, 8C and 8D. The user can grasp the ribbon unit 7 or the tape unit 19 through the recess 130 or 132. FIGS. 8A, 8B, 8C and 8D are side elevational views when the ribbon 7 and the tape unit 19 are set to the cassette case body 3 and the cassette case lid 5 is attached. Openings 18, 202, 204, 206 and 208 indicated in FIG. 7 are provided in the cassette case body 3. The circular openings 202 and 204 are holes into which the ribbon driving cam 9 and the ribbon supply cam 31 are loosely fitted, and the rectangular openings 206 and 208 are holes corresponding to the ribbon sensor 71, 73, 75 and the tape sensors 77, 79, 81, respectively.

As shown in FIG. 6, circular openings 212 and 210 corresponding to the ribbon driving cam 29 and the ribbon supply cam 31 are provided in the cassette case lid 5 similarly to in the cassette case body 3. Further, a pair of holes 116 of a small diameter are holes into which the shafts 114 of the cassette case body 3 are fitted. As described above, the iron plates 200 corresponding to the magnets 134 are provided at four locations, and positioning ribs 214, 216, 218 and 220 for cooperating with the cassette case body 3 are provided projectingly at corner portions. FIG. 9 shows the bottom wall of the ribbon unit 7, and as shown in FIG. 9, the ribbon unit 7 has a vertically symmetrical profile such that the sensor holes 25 and 27 (shown in FIG. 1) in the upper wall of the ribbon unit 7 and the sensor holes 25b and 27b in the bottom wall are provided at locations that are symmetrical with respect to a longitudinal center line of the ribbon unit 7 so that, even if the ribbon unit 7 is mounted upside down, it can be detected similarly by the ribbon sensors 71, 73, 75.

A central portion of each of the ribbon guide rollers 17 presents a through hole as shown in FIG. 5 so that, in whichever vertical direction the ribbon guide roller 17 is mounted onto the cassette case body 3, the shaft 114 of the cassette body 3 is fitted into the through hole. Since the ribbon unit 7 has a vertical symmetrical profile in this manner, it can be mounted either upward or downward. While a one-time ribbon is commonly used on conventional tape producing devices, where the ribbon holder has such a profile as in the present invention, a multi-time ribbon can be mounted and used a plurality of times. As shown in FIGS. 1 and 2, the ribbon unit 7 includes the ribbon spools 13 and 15 on which the ink ribbon 9 is wound, the ribbon guide rollers 17, the ribbon holder lid 92 and the ribbon holder 100. Springs such as the ribbon back tension spring 41 (FIGS. 3 and 4) are installed on the apparatus body 1 side. Accordingly, the ribbon unit 7 includes very few parts and only parts formed of resin without the use of any metal parts. Consequently, parts to be scrapped are very small in number, and separate recovery upon scrapping is very easy.

FIGS. 10A to 10D show the tape unit 19. The tape unit 19 includes the tape holder 102 and the tape 21 wound around the spool 118 as described hereinabove. The tape holder 102 has a pair of sensor holes 250 and 252 provided on the bottom wall thereof corresponding to the tape sensors 77, 79, 81 of FIG. 3. In the case of the present tape unit 19, the tape sensor 77 and the tape sensor 79 are in an OFF state while the tape sensor 81 is in an ON state. A fitting hole 129 is provided in the rib 102*b* of the tape unit 19 and defines the vertical position of the tape 21 at the tape exit. The tape holder 102 and the spool 118 are made of the same resin material as an ABS resin, and only the two parts remain after the tape 21 is consumed. In this instance, since they are formed of the same parts, they need not be disassembled every time upon separate recovery for scrapping, and recycling of the material is facilitated. Alternatively, the tape holder 102 may be formed of paper instead of a resin so that it may be readily disassembled. In this manner, both the tape unit 19 and the ribbon unit 7 include few parts to be scrapped so that separate recovery and recycling of the material can be facilitated.

Figure 11:
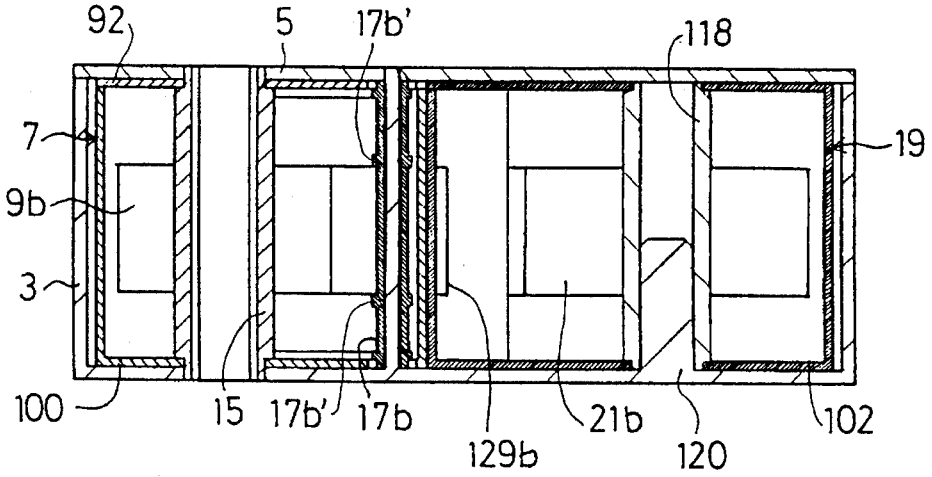
FIG. 11 is a sectional view corresponding to FIG. 5 but illustrating a condition in which an ink ribbon unit and a tape unit of a small width type in another embodiment according to the present invention are mounted.
Figure 12A:
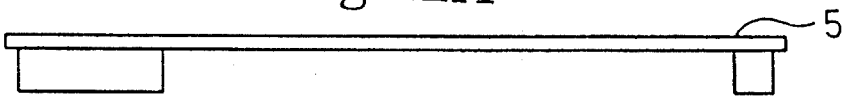
FIG. 12A is a side elevational view of a tape cassette lid of a small width type.
Figure 12B:
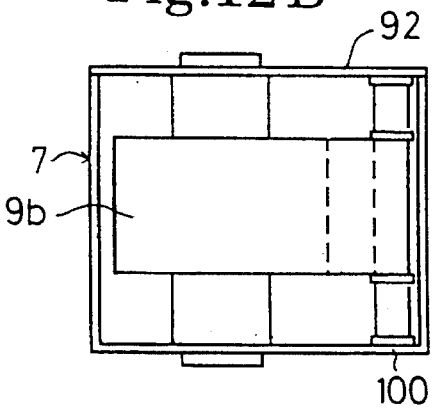
FIG. 12B is a side elevational view of a ribbon unit of a small width type.
Figure 12C:
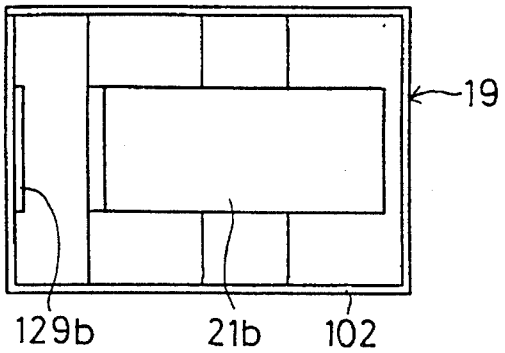
FIG. 12C is a side elevational view of a tape unit of a small width type.
Figure 12D:
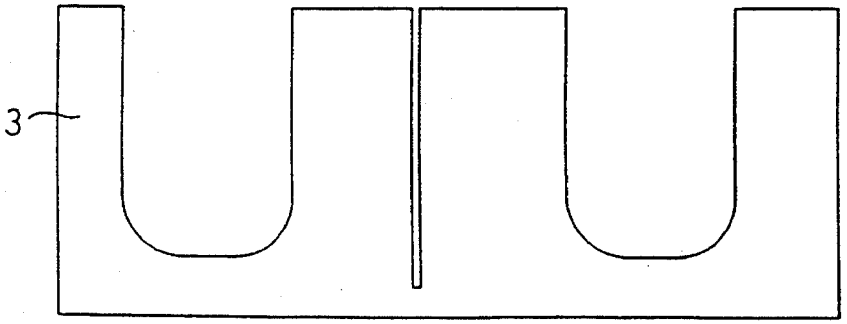
FIG. 12D is a side elevational view of a cassette case body of a small width type.

While the tape 21 and the ink ribbon 9 of the large width type are described so far, those of a small width type will now be described with reference to FIGS. 11 and 12. The cassette case body 3, the cassette case lid 5, the ribbon holder body 100, the ribbon holder lid 92 and the tape holder 102 are the same as those in the embodiment described above. First, an ink ribbon 9*b* of a small width is wound at a central portion of the ribbon spool 15 of the ribbon unit 7 as shown in FIG. 11, and a guide portion 17*b*' is provided on the ribbon guide roller 17*b*. Accordingly, even if the width of the ink ribbon is different, the vertical position of the ink ribbon is defined.

Sensor holes (not shown), different from those of the embodiment described above, are provided in the ribbon holder body 100 such that the ribbon sensor 71 and the ribbon sensor 75 are in an ON state while the ribbon sensor 73 is in an OFF state. Also in the tape unit 19, the tape 21*b* is wound at a central portion of the spool 118, and a fitting hole 129*b* of a tape exit is formed narrow in conformity with the width of the tape 21*b*. Different from the ribbon holder body of the large width type, the sensor holes 250 and 252 are not provided so that all of the tape sensors. 77, 79, 81 are in an ON state. Accordingly, the ribbon sensors and the tape sensors are discriminated by the ribbon unit 7 and the tape unit 19, respectively, and the positions of the ink ribbon 9 and the tape 21 in the vertical direction are defined by the ribbon unit 7 and the tape unit 19, respectively. Consequently, if the user prepares the single tape cassette 2, the tape 21 and the ink ribbon 9 of any width or any type can be used.

Figure 13:
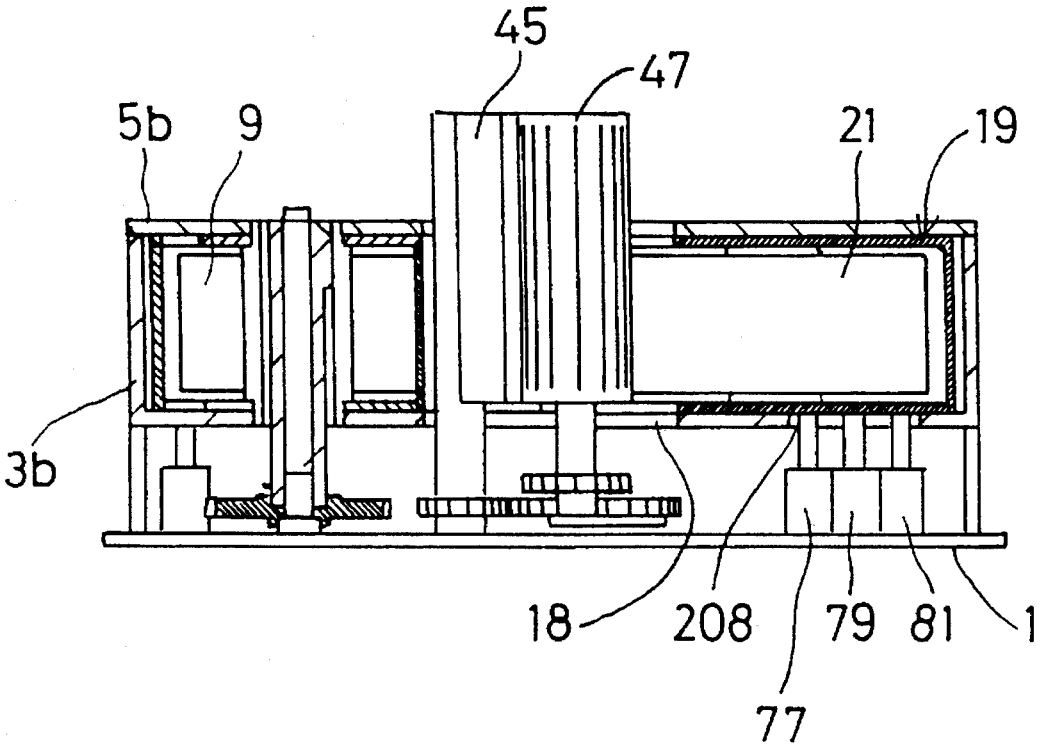
FIG. 13 is a sectional view corresponding to FIG. 5 but in a condition wherein the tape cassette of a small width type in the embodiment according to the present invention is mounted in the tape producing apparatus body.
Figure 14:
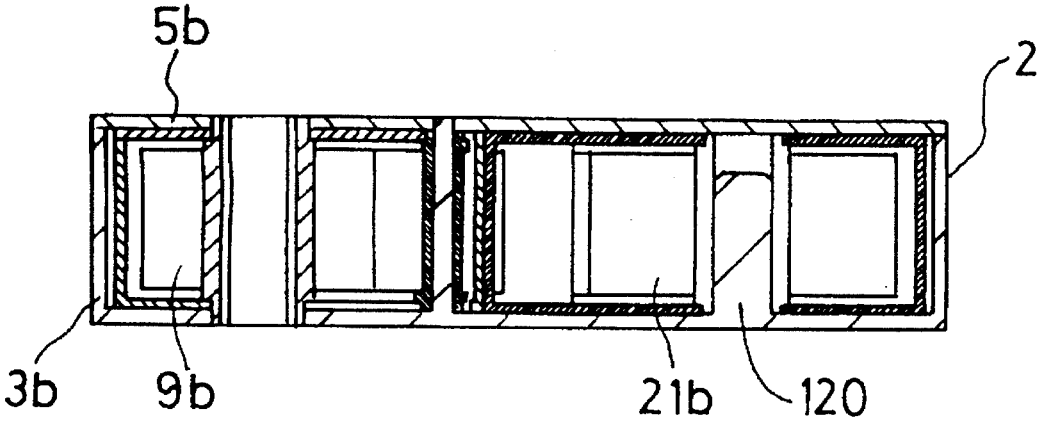
FIG. 14 is a sectional view corresponding to FIG. 5 but showing the tape cassette of a small width type in the embodiment according to the present invention.
Figure 15:
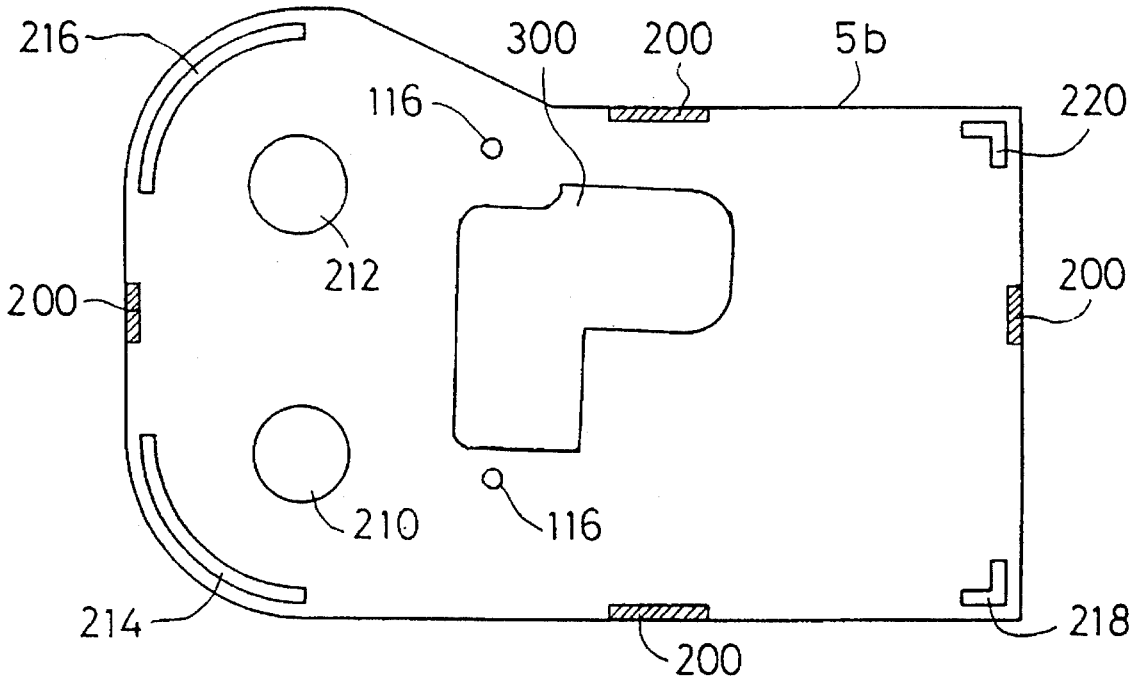
FIG. 15 is a bottom plan view of a cassette case lid in the embodiment according to the present invention.

While in the present embodiment the same cassette case body 3 and the same cassette case lid 5 are used irrespective of the width of the tape 21 or the ink ribbon 9, the size of the tape cassette 2 may be varied in accordance with the width of the tape 21 or the ink ribbon 9 as in the following example. As shown in FIG. 14, for the tape 21 and the ink ribbon 9 of the small widths, a cassette case body 3*b* and a cassette case lid 5*b* having small widths are used. In this instance, the bottom face of the cassette case body 3*b* serves as a reference in height to the apparatus body 1 as shown in FIG. 13. The cassette case lid 5*b* has an opening 300 as shown in FIG. 15 so that the thermal head 45 and the platen 47 of FIG. 3 may be inserted into the opening 300. Accordingly, even if the size of the tape cassette 2 is different, it can be discriminated by means of the ribbon sensors 71, 73, 75 and the tape sensors 77, 79, 81.

Figure 16:
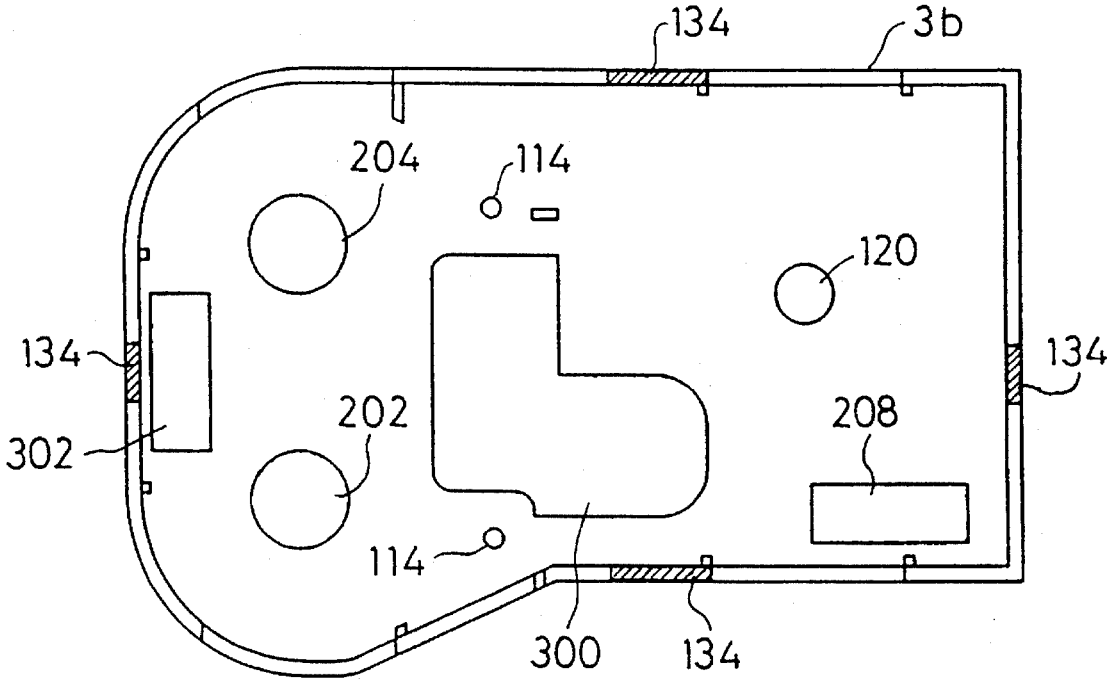
FIG. 16 is a plan view of a cassette case body in the embodiment according to the present invention.

While the positions of the ink ribbon 9 and the tape 21 in the vertical direction are defined by the ribbon unit 7 and the tape unit 19, respectively, when the size of the tape cassette 2 is varied in accordance with the width of the ink ribbon 9 or the tape 21 as in the present example, the ink ribbon 9 and the tape 21 may be positioned in the vertical direction by the cassette case body 3 and the cassette case lid 5. Further, as shown in FIG. 16, the hole 302 of the cassette case body 3*b* is closed up at a portion corresponding to the hole 27 of the ribbon holder body 100 (FIG. 1), different from the large width cassette case body 3. Consequently, the ribbon sensor 75 (FIG. 3) is always in an ON state, and it is discriminated by the cassette case body 3*b* that the ink ribbon 9 is of a small width type.

In the embodiment described above, the ribbon unit 7 is of the vertically reversible type, and back tension to the ink ribbon 9 is applied on a side of the apparatus body 1. However, where a one-time ink ribbon 9' is used, the ribbon unit need not be the ribbon unit 7 of the vertically reversible type, and back tension to the ink ribbon 9 may be applied from a cassette case body 3*c*. This will be described below with reference to FIGS. 17 to 21.

Figure 17:
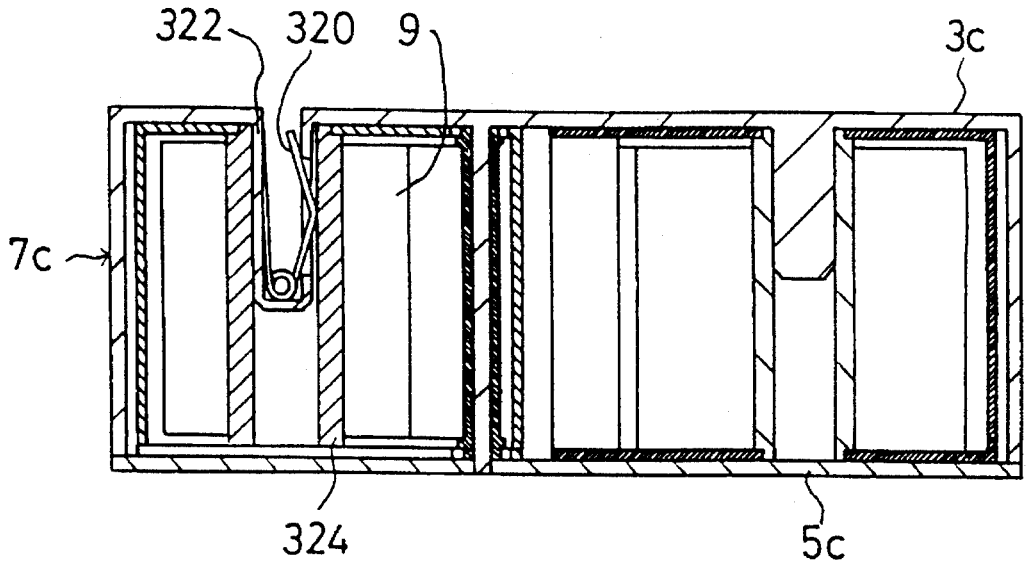
FIG. 17 shows a tape cassette in the embodiment according to the present invention and is a sectional view taken along a line 17—17 of FIG. 18.
Figure 18:
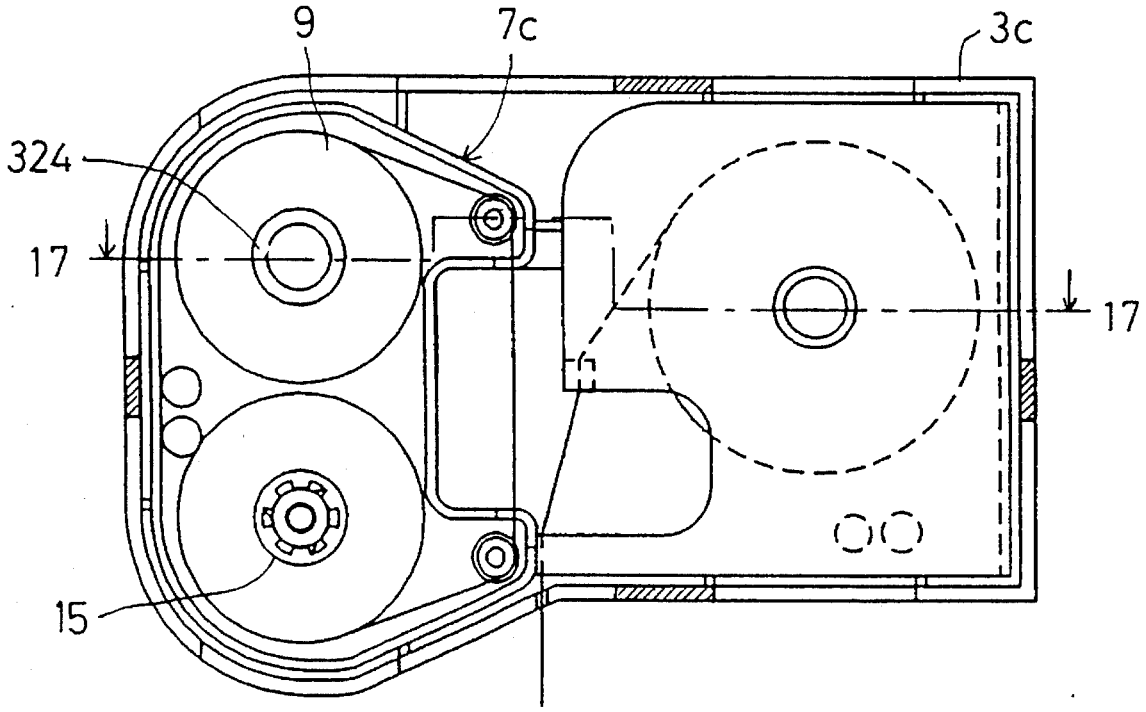
FIG. 18 shows a tape cassette in the embodiment according to the present invention and is a plan view in a condition wherein a cassette case lid is removed.
Figure 19:
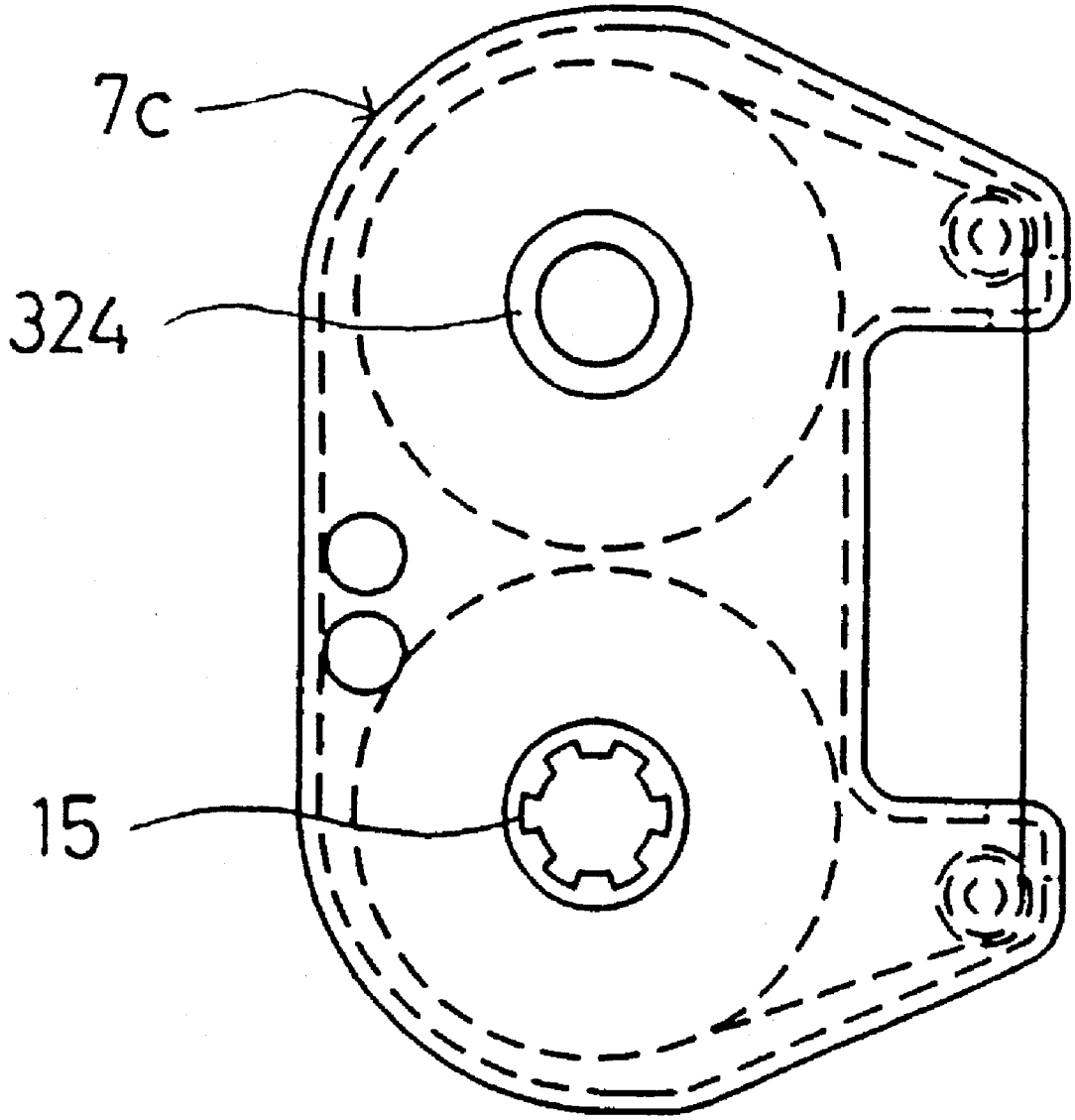
FIG. 19 is a plan view showing a tape unit in the embodiment according to the present invention.
Figure 20:
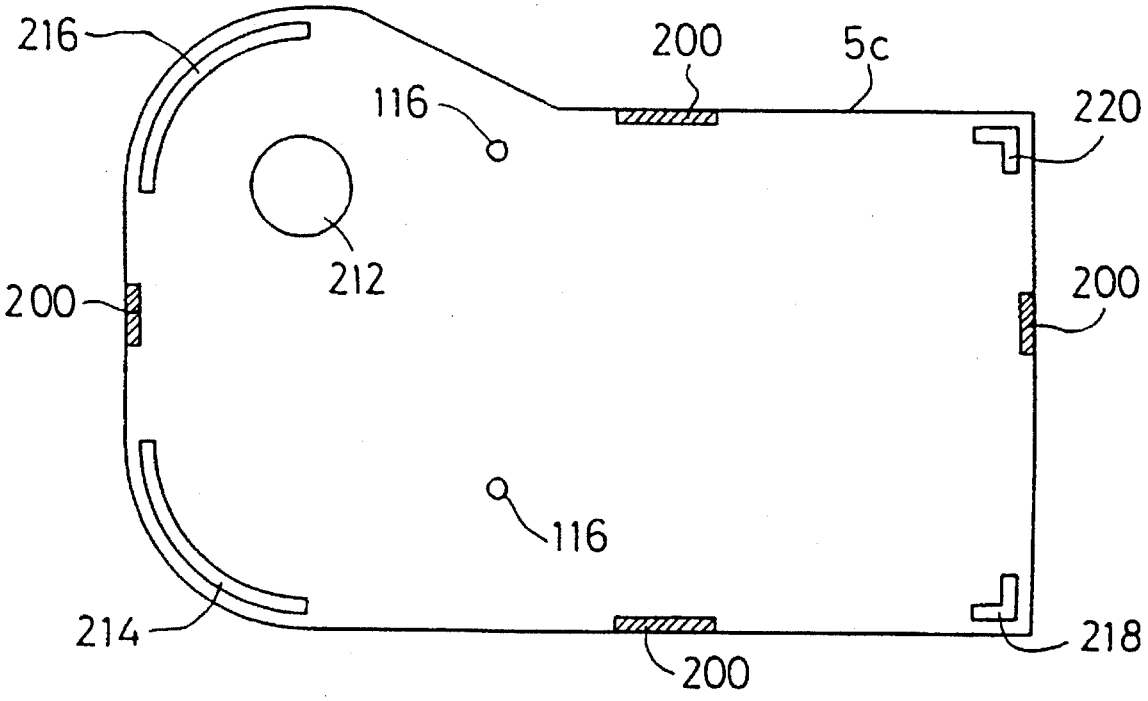
FIG. 20 is a bottom plan view of a cassette case lid in a further embodiment according to the present invention.
Figure 21:
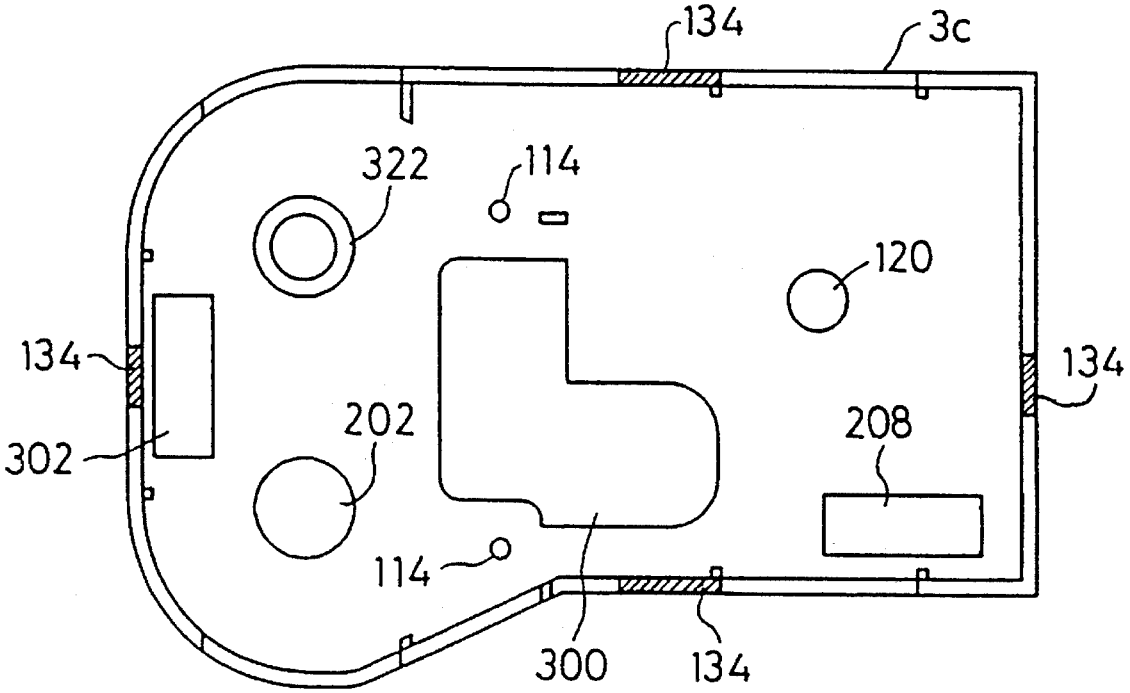
FIG. 21 is a plan view of a cassette case body in the embodiment according to the present invention.

As shown in FIG. 17, a boss 322 is provided on the cassette case body 3*c*, and a back tension spring 320 is attached to a recessed portion of the boss 322. When a ribbon unit 7*c* is mounted in the cassette case body 3*c*, a ribbon spool 324 is brought into such a condition where the back tension spring 320 is flexible. By the spring force, friction force is produced between the boss 322 and the spool 324 so that back tension is applied to the ink ribbon 9. The spool 324 does not have such a rib 15*a* (FIG. 2) as of the ribbon spool 15 and has a cylindrical profile. As shown in FIGS. 20 and 21, the opening hole 210 of FIG. 6 is not provided in the cassette case lid 5*c*, and the cassette case 3*c* is common to that of the embodiment described hereinabove except that the circular opening portion 204 of FIG. 7 is replaced by the boss 322. Further, the ribbon unit 7*c* (FIG. 19) is common to that of the embodiment described above except that the ribbon spool 13 of FIG. 1 is replaced by the spool 324 of FIG. 18.

Discrimination methods of the ribbon sensors and the tape sensors will be described. Table 1 and Table 2 below illustrate discrimination methods for the ink ribbon 9 and the tape 21, respectively. The types of the ink ribbon 9 and the tape 21 employed are discriminated by combinations of ON and OFF states of the sensors 71 to 81. The maximum height of characters to be printed and the maximum widthwise printing range are determined based on the ribbon sensors and the tape sensors. In short, the user may mount the ribbon unit 7 of a different ribbon width and the tape unit 19 of a different tape width, or the tape units 19 of different widths may be successively replaced and used for the ribbon unit 7 of a single width. In those instances, if the printing range is not adjusted to a smaller one of the widths of the tape 21 and the ribbon 9, then characters protrude from the tape width or the width of the ribbon is so small that characters are cut. Therefore, information of both of the ribbon sensors and the tape sensors is used so that the printing range may be set in conformity with a smaller one of the widths.

Alternatively, an error message may be developed when the tape width and the ink ribbon width do not coincide with each other or when the tape width is smaller than the ink ribbon width.

Since the compositions of the inks of a tape ribbon and a lettering ribbon are different from each other, the energy to be supplied to the thermal head 45 is different, and non-reverse image printing is performed for a tape while mirror image printing must be performed for a lettering sheet. Therefore, the two ribbons are distinguished from each other. When the combination of a tape ribbon and a tape or the combination of a lettering ribbon and a lettering sheet is not assured correctly, an error message is signalled. For example, the tape cassette of FIG. 1 in the embodiment described above accommodates a ribbon for a 30 mm tape and a 30 mm tape therein while the tape cassette of FIG. 11 accommodates a ribbon for a 12 mm tape and a 12 mm tape.

TABLE 1

RIBBON SENSOR CRITERION TABLE

| No | SENSOR 71 | SENSOR 73 | SENSOR 75 | CRITERION CONTENT |
|---|---|---|---|---|
| 1 | ON | ON | ON | 12 mm lettering ribbon |
| 2 | ON | OFF | ON | 12 mm tape ribbon |
| 3 | ON | ON | OFF | 30 mm lettering ribbon |
| 4 | ON | OFF | OFF | 30 mm tape ribbon |
| 5 | OFF | OFF | ON | 12 mm cassette, no ribbon |
| 6 | OFF | OFF | OFF | 30 mm cassette, no ribbon |

TABLE 2

TAPE SENSOR CRITERION TABLE

| No | SENSOR 77 | SENSOR 79 | SENSOR 81 | CRITERION CONTENT |
|---|---|---|---|---|
| 1 | ON | ON | ON | 12 mm tape |
| 2 | ON | OFF | ON | 12 mm lettering sheet |
| 3 | OFF | OFF | ON | 30 mm tape |
| 4 | OFF | ON | ON | 30 mm lettering sheet |
| 5 | OFF | OFF | OFF | no tape |

The following examples may be available in addition to the examples described so far. As shown in FIG. 11, a tape unit 19 for a ribbon for a 30 mm tape and for a mm tape is mounted. The tape 21 is offset downwardly from the center of the ink ribbon 9 and corresponds to the range of the lower half of the ink ribbon 9. Accordingly, the ink ribbon 9 is used normally at the lower half thereof. After the ink ribbon 9 is used up, the ribbon unit 7 is re-mounted in the cassette case body 3 in a reversed condition. Consequently, printing can be performed further for the length of the ink ribbon 9. Accordingly, when a small width tape is used, a long printing range can be assured with a small capacity. In this instance, the ribbon sensor 75 and the tape sensor 77 discriminate in such a manner as listed in Table 3 below. In short, when an ink ribbon of a large width and a tape of a small width are mounted, the small width tape is discriminated while simultaneously the printing range is set only to a lower portion of the thermal head 45. Consequently, a printing range appropriate to a tape position is set.

TABLE 3

PRINTING POSITION CRITERION TABLE

| No | SENSOR 75 | SENSOR 77 | PRINTING POSITION (RANGE) |
|---|---|---|---|
| 1 | ON | ON | entire portion of thermal head |
| 2 | ON | OFF | entire portion of thermal head |
| 3 | OFF | ON | lower portion of thermal head |

TABLE 3-continued

| PRINTING POSITION CRITERION TABLE | | | |
|---|---|---|---|
| No | SENSOR 75 | SENSOR 77 | PRINTING POSITION (RANGE) |
| 4 | OFF | OFF | entire portion of thermal head |

The present invention is not limited to the present embodiments and can be applied without departing from the spirit thereof. For example, while only two widths are described for each of the tape and the ink ribbon in the present embodiments, it is possible to accommodate a plurality of widths.

What is claimed is:

1. A tape cassette in a tape printing apparatus for printing on a tape using an ink ribbon, the tape cassette comprising:

a cassette housing holding both a ribbon unit and a tape unit therein;

said ribbon unit having a ribbon holder housing, enclosing said ink ribbon wound around at least one ribbon spool, said ribbon unit being separately removable from said cassette housing and said tape unit without reguiring removal of said tape unit; and said tape unit having a tape holder housing, enclosing said tape wound around a tape spool, said tape unit being separately removable from said cassette housing and said ribbon unit without requiring removal of said ribbon unit, thereby enabling independent replacement of said ribbon unit and said tape unit.

2. The tape cassette according to claim 1, wherein said ribbon unit comprises a vertically symmetrical profile such that it can be inserted in said tape cassette in at least two orientations.

3. The tape cassette according to claim 2, wherein a width of said tape is about one-half the width of said ink ribbon.

4. The tape cassette according to claim 2, wherein said ink ribbon is a multi-use ink ribbon.

5. The tape cassette according to claim 1, wherein said ink ribbon unit comprises discriminating means for indicating an ink ribbon type of said ink ribbon and said tape unit comprises discriminating means for indicating a tape type of said tape.

6. The tape cassette according to claim 1, wherein said ribbon unit and said tape unit are manufactured from the same material.

7. The tape cassette according to claim 6, wherein said material is a resin material.

8. The tape cassette according to claim 6, wherein said material is paper.

9. The tape cassette according to claim 1, wherein said ink ribbon is a multi-use ink ribbon.

10. The tape cassette according to claim 1, further comprising ribs protruding from said cassette housing, wherein a position of said ribbon unit and said tape unit in said cassette housing in a transverse direction of said tape is defined by said ribs.

11. The tape cassette according to claim 1, further comprising a cassette case lid for closing said cassette housing, wherein at least one magnet is fixed to one of said cassette housing and said cassette case lid, and a corresponding at least one metal plate is fixed to the other of said cassette housing and said cassette case lid for engaging said at least one magnet.

12. The tape cassette according to claim 1, wherein said cassette housing further comprises at least one recess providing access to a corresponding at least one of said ribbon unit and said tape unit.

13. The tape cassette according to claim 1, wherein at least one of said ribbon unit and said tape unit is manufactured from a single material.

14. A tape printing apparatus for printing on a tape using an ink ribbon, the tape printing apparatus comprising a tape cassette, the tape cassette comprising:

a cassette housing holding both a ribbon unit and a tape unit therein;

said ribbon unit having a ribbon holder housing, enclosing said ink ribbon wound around at least one ribbon spool, said ribbon unit being separately removable from said cassette housing and said tape unit without requiring removal of said tape unit;

said tape unit having a tape holder housing, enclosing said tape wound around a tape spool, said tape unit being separately removable from said cassette housing and said ribbon unit without requiring removal of said ribbon unit, thereby enabling independent replacement of said ribbon unit and said tape unit; and discriminating means for indicating an ink ribbon type of said ribbon unit and for indicating a tape type of said tape.

15. The tape printing apparatus according to claim 14, further comprising means for setting a printing range in accordance with an indication from said discriminating means.

16. The tape printing apparatus according to claim 14, further comprising means for generating an error signal if a ribbon type indicated by said discriminating means and a tape type indicated by said discriminating means are incompatible.

17. The tape printing apparatus according to claim 14, wherein said discriminating means comprises at least one sensor fixed to said tape cassette, said at least one sensor determining at least one of said ribbon type of said ribbon and said tape type of said tape.

18. The tape printing apparatus according to claim 14, wherein said ribbon unit comprises a ribbon supply cam engaging said ink ribbon, and a tension spring wound on said ribbon supply cam, said tension spring applying tension to said ink ribbon when said ink ribbon is rotated.

* * * * *